US007467826B1

(12) United States Patent
Wen

(10) Patent No.: US 7,467,826 B1
(45) Date of Patent: Dec. 23, 2008

(54) RESILIENCE TILT-ADJUSTED DEVICE OF BACKREST

(75) Inventor: Ming-Hung Wen, Min-Shiung-Shiang (TW)

(73) Assignee: Hurng Taih Plastic Master Batch Co., Ltd., Chiayi County (TW)

( * ) Notice: Subject to any disclaimer, the term of this patent is extended or adjusted under 35 U.S.C. 154(b) by 0 days.

(21) Appl. No.: 11/947,973

(22) Filed: Nov. 30, 2007

(30) Foreign Application Priority Data

Aug. 14, 2007 (TW) ..... 96213358 U

(51) Int. Cl.
*A47C 1/024* (2006.01)

(52) U.S. Cl. ..... 297/303.4; 297/300.8

(58) Field of Classification Search ..... 297/301.4, 297/301.7, 303.4, 303.1, 300.5, 300.8
See application file for complete search history.

(56) References Cited

U.S. PATENT DOCUMENTS 5,222,783 A * 6/1993 Lai ..... 297/301.4
5,725,276 A * 3/1998 Ginat ..... 297/289
6,945,603 B2 * 9/2005 Elzenbeck ..... 297/303.4
7,080,884 B2 * 7/2006 Daeschle et al. ..... 297/303.4

* cited by examiner

*Primary Examiner*—Milton Nelson, Jr.
(74) *Attorney, Agent, or Firm*—Alan Kamrath; Kamrath & Associates PA

(57) ABSTRACT

An office chair having a resilience tilt-adjusted device of a backrest includes an upper and a lower casing put together to cover an elastic adjuster which can press one end of elastic members with difference forces. Another end of the elastic members leans against an axle rod which is disposed at the lower end of the backrest supporter. The two ends of the axle rod pass through the casing. The lower end of the backrest is pivotally connected to a predetermined area within the casing as a pivot for swinging. A positioning rod having a rack is passed through the center of the axle rod so as to insert the rack onto the guiding groove of the casing. A positioning piece is arranged upon the rack and can be controlled to move up and down for inserting its end into the rack. Therefore, when the positioning piece is inserted into or exited from the rack, the backrest supporter can be positioned in a desirable angle after tilting. Also, when the positioning piece is away from the rack, the user can have a different level of resilience against leaning on the backrest by the adjustment of the elastic adjuster as well as the elastic members.

6 Claims, 9 Drawing Sheets

RESILIENCE TILT-ADJUSTED DEVICE OF BACKREST

DESCRIPTION

1. Field of the Invention

The present invention is a backrest tilt-adjusted device together with a resilience device arranged inside a casing, wherein the device can not only adjust the inclined angle of a backrest but also can control the resilience level of inclination.

2. Background of the Invention

Office chairs are often made with the function of being tilt-adjusted as well as having a leaning resilience. As an example, Taiwan Pat. No. M240905 disclosed a rear end of a seat base including a positioning body with a plural number of locking grooves. The positioning pieces disposed at the base can be inserted into or exited from the locking grooves at a different position. Thus, the backrest is allowed to be in different angles and position via adjustment. Since the positioning pieces are rotated and swung according to the base, the angle of insertion is constantly changed. Therefore, the angle of each locking groove of the positioning body is different. Thus, the difficulty and cost are increased while having the manufacturing process regarding the locking grooves of the positioning body being inconvenient.

Furthermore, in order to have a comfortable resilience backrest of the seatback, such as shown in FIGS. 1 and 2, a screw 92 is locked to the base 91 by its upper end. The lower end of the screw 92 is passed through a supporter 93 and further screwed at an adjusting nut 94. A spring 95 is disposed between the adjusting nut 94 and the supporter 93. Thus, the adjusting nut 94 can be screwed tight or released so as to allow the spring 95 to be pressed by different forces. Therefore, when the user leans on the backrest and reclines backward, the different level of resilience would be provided to the user. Since there is only one spring 95 and it is too weak to support the backrest, the wire diameter of the spring 95 has to be relatively thick in order to reinforce its elasticity for supporting the backrest. Hence, the elasticity of the backrest can not reach the proper level of resilience. Nevertheless, while the backrest inclines backward, the upper end of the screw 92 bears a great pulling force to the base 91 and can cause the base 91 to be damaged and split due to excessive stress.

SUMMARY OF THE INVENTION

Therefore, in order to overcome the above-mentioned defect of difficult processing of the backrest tilt-adjusted device, the problem of the backrest with a hardening resilience of reclining as well as the problem of the base being damaged or split, the present invention utilizes a method to resolve the problem. Specifically, an upper and a lower casing are pivotally connected to a free swung backrest supporter. An axle rod passes through the lower end of the backrest supporter. The axle rod leans against one end of elastic member, and the other end of the elastic members are also pushed by an elastic adjuster disposed inside the casing. Therefore, the elastic adjuster can have different forces to press the elastic members.

In addition, the center of the axle rod passes through a positioning rod with a rack. The rack of the positioning rod passes through a guiding groove within the casing. A positioning piece can be controlled to move up and down for inserting its end portion into the rack.

Hence, by using the function of exiting from or inserting the positioning piece into the rack of the positioning rod according to the present invention, the backrest supporter can be adjusted and positioned in a desirable angle of inclination. When the positioning piece exits from the rack, the elastic members can provide resilience and bounce to the backrest and the elastic adjuster can also be adjusted to reach a proper resilience for reclining. Also, the components of the tilt-adjusted device is not going to be damaged.

BRIEF DESCRIPTION OF THE DRAWINGS

It should be understood that the drawings are provided for the purpose of illustration only and are not intended to define the limits of the invention. The foregoing and other advantages of the embodiments described herein will become apparent with reference to the following detailed description when taken in conjunction with the accompanying drawings in which.

DETAILED DESCRIPTON OF THE INVENTION

Figure 1:
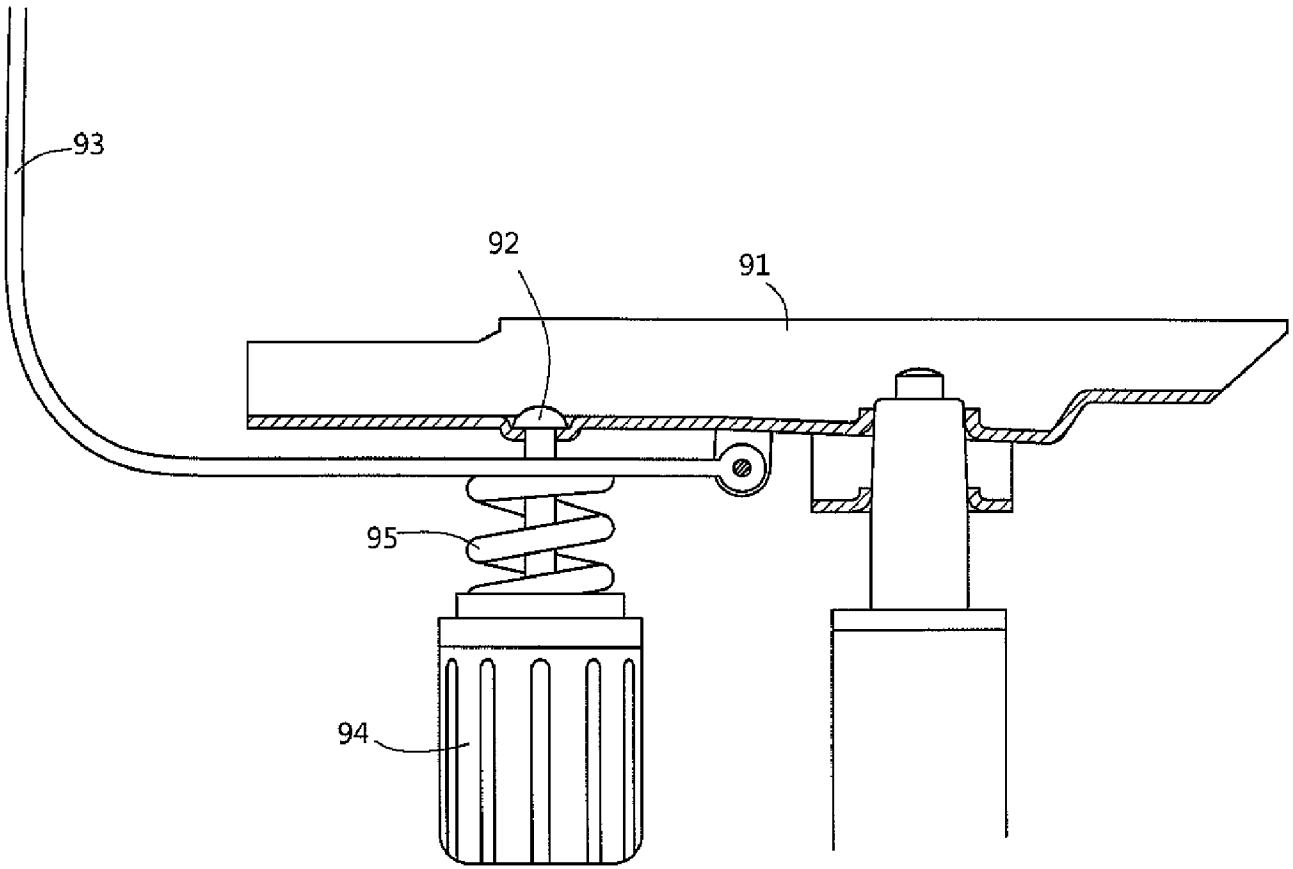
FIG.1 (PRIOR ART)
FIG. 1 is a perspective view of a prior art backrest elastic device structure.
Figure 2:
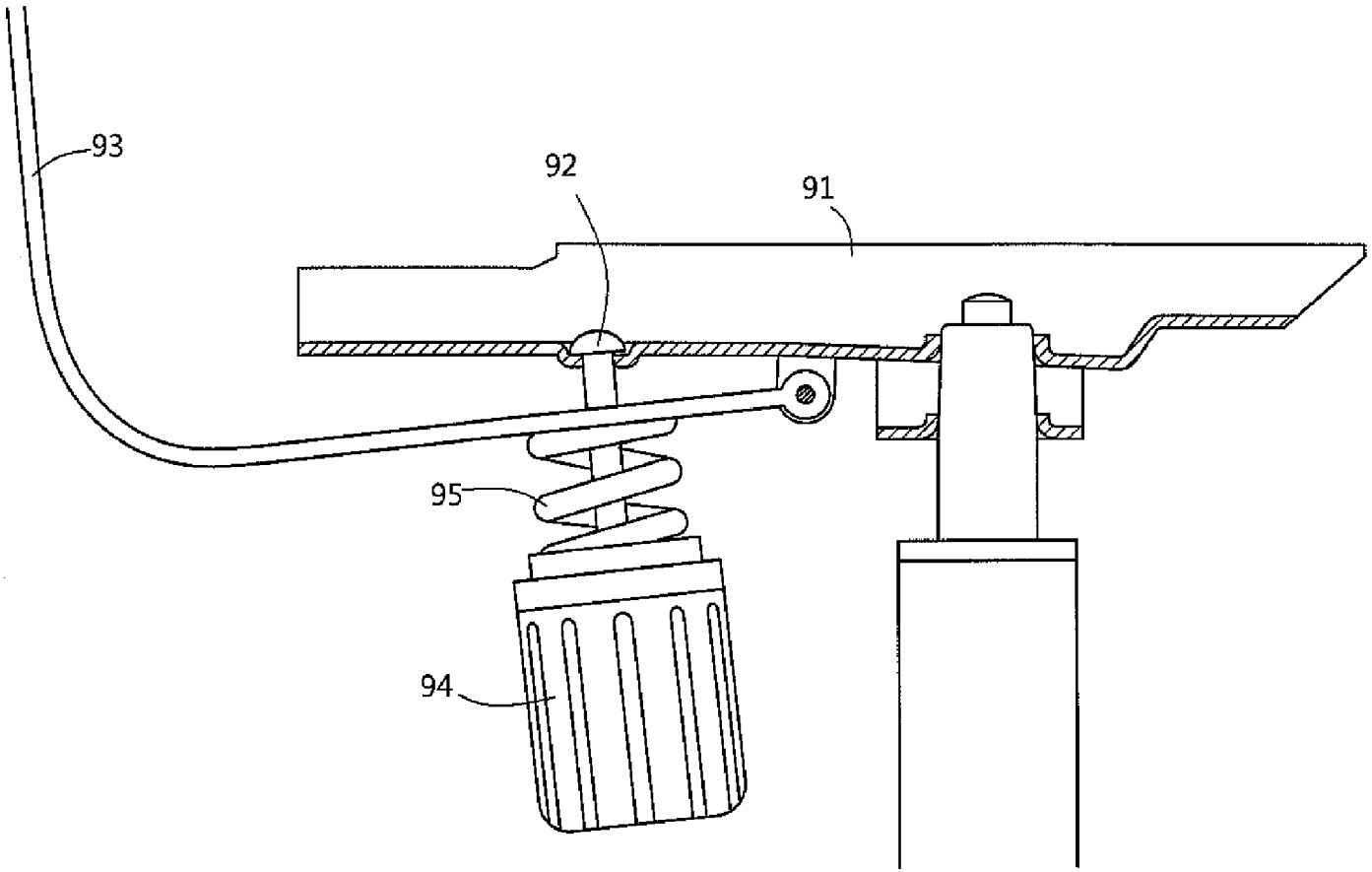
FIG.2 (PRIOR ART)
FIG. 2 is a perspective view of a prior art backrest elastic device structure.
Figure 3:
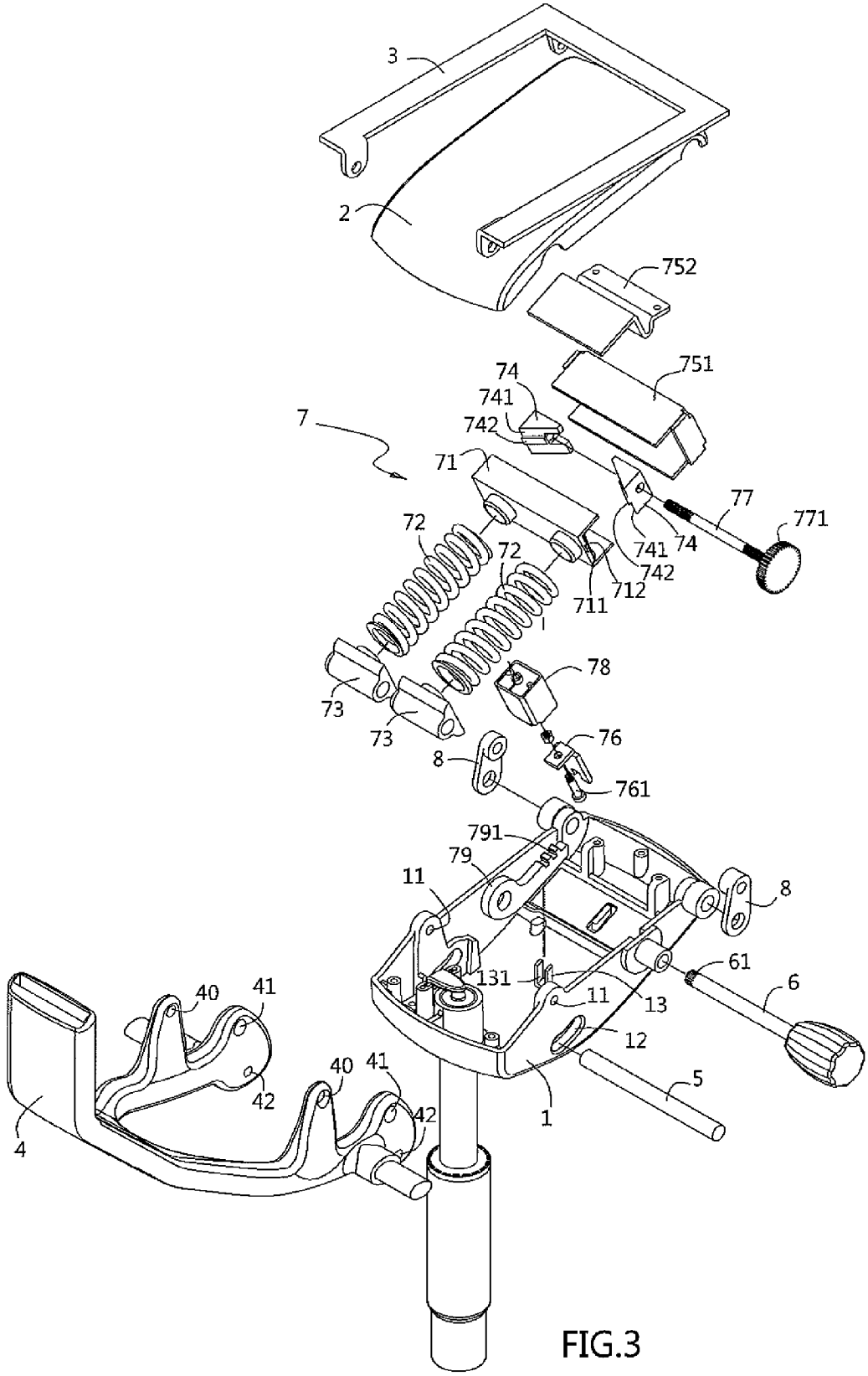
FIG. 3 is an exploded perspective view of the device according to the present invention.
Figure 4:
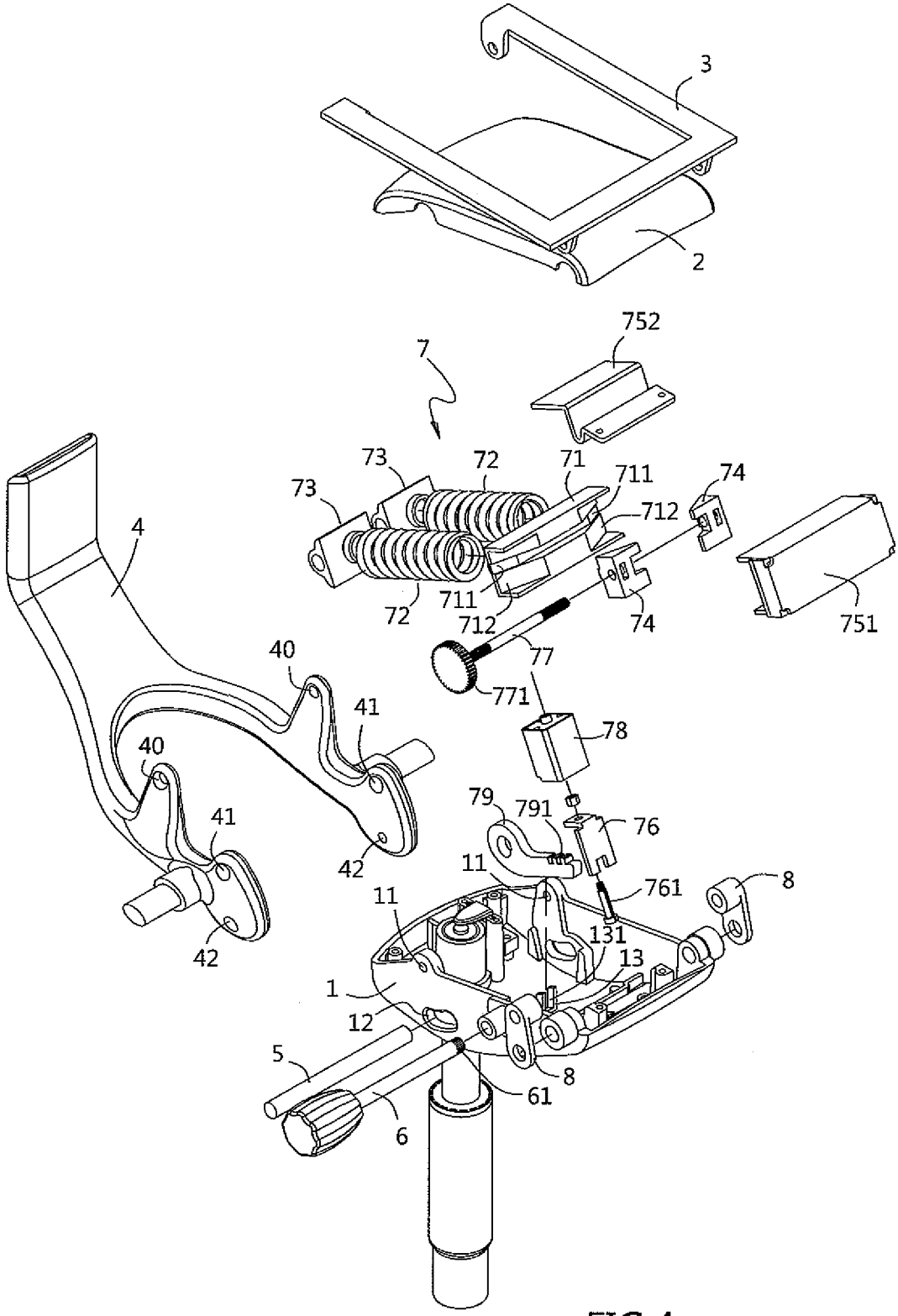
FIG. 4 is another exploded perspective view of the device according to the present invention.
Figure 5:
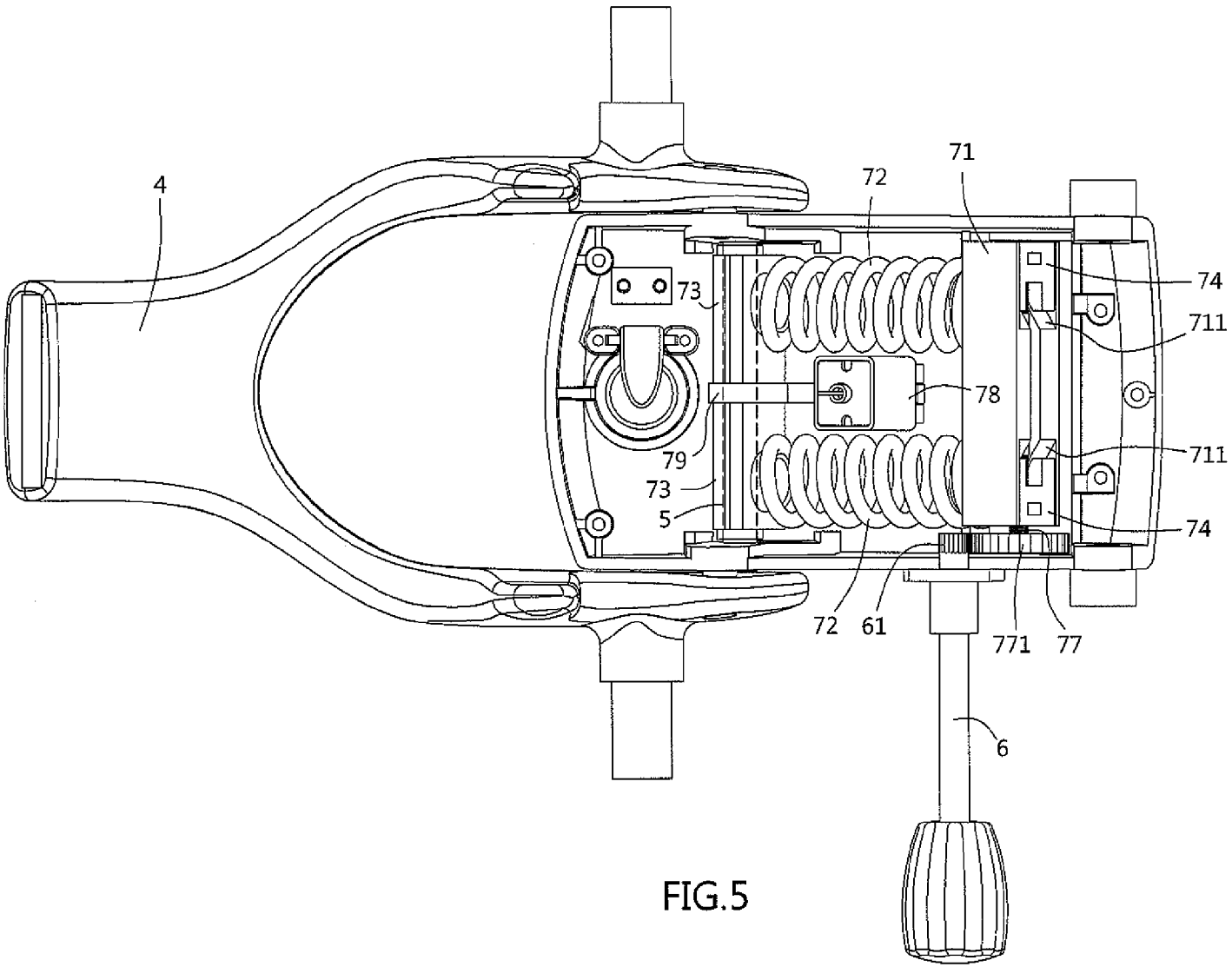
FIG. 5 is a top plan view of the device without the supporting base and the upper casing according to the present invention.
Figure 6:
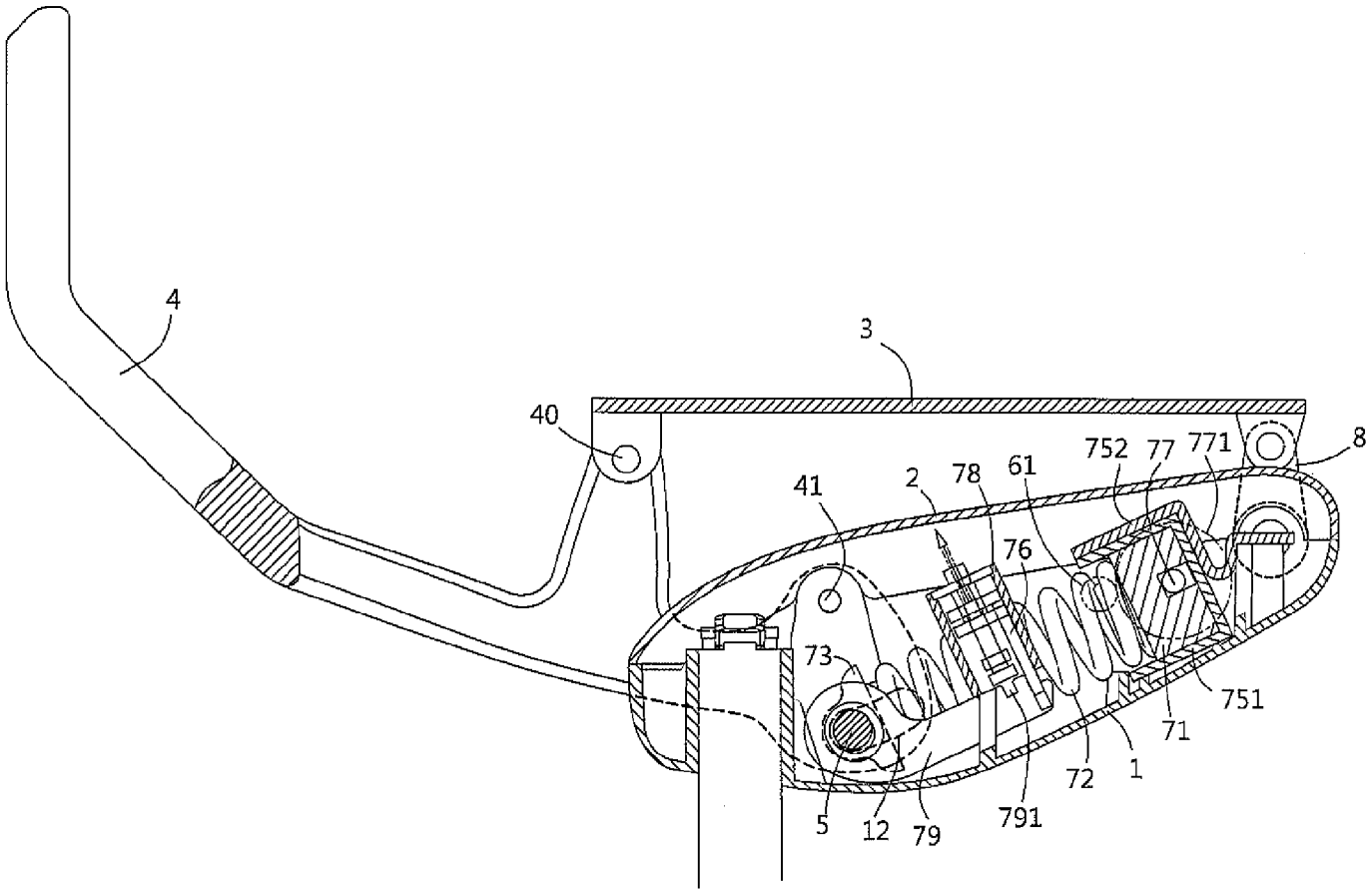
FIG. 6 is a side perspective view of the device according to the present invention.

Referring to FIGS. 3, 4, 5 and 6, the present invention includes an upper and lower casing 1, 2 which cover an elastic adjuster 7. A fixed pivotal point 11 of the casing 1 is pivotally connected to a pivotal aperture 41 of a backrest supporter 4 so as to swing the backrest supporter 4 freely. A pivotal point 40 of the backrest supporter 4 is connected to a rear end of a supporting base 3 where a seat is located. The front end of the casing 1 is pivotally connected to the front end of the supporting base 3 via a connecting member 8. An axle rod 5 passes through a through hole 42 of the lower end of the backrest supporter 4 within the casing 1. The wall of the casing 1 has a slot 12 through which the axle rod 5 passes. The elastic adjuster 7 includes resisting bases 73 which are passed through by the axle rod 5 at its two sides, a positioning rod 79, and elastic members 72 located against the resisting bases 73. The other ends of the elastic members 72 are also against a side of a compressing base 71. The other side of the compressing base 71 has a inclined surface 712 disposed correspondingly at each end, and each inclined surface 712 has an inclined guiding groove 711. Furthermore, a sliding piece 74 is disposed at each inclined surface 712 and is slideable upon a parallel inclined surface 741. A guiding portion 742 projects from the parallel inclined surface 741 so as to slide within the inclined guiding groove 711 of the compressing base 71. The sliding pieces 74 are passed through by a screw 77. The passing through points of the screw 77 and the sliding pieces 74 are shown each with different screw threads of right and left. The outside end of the screw 77 has a gear portion 771 which clenches the teeth of a gear wheel portion 61 which is arranged at the passing end of a turning bar 6 and which passes through the casing 1. Thus, the screw 77 can be rotated forward or backward by turning the turning bar 6 clockwise or counter-clockwise. Therefore, the two sides of the sliding pieces 74 can be moved relatively either inward or outward along the screw 77. Since the force between the compressing base 71 and the sliding piece 74 and the inclining surface 712 and the parallel inclined surface 741, the compressing base 71 can be moved toward the elastic members 72 in order to reinforce the pressure or reduce the pressure to the elastic members 72 by moving backward.

In addition, a cover 751 maintains and covers the compressing base 71 and the sliding pieces 74. The cover 751 is fixedly connected to the casing 1 by fastening a pressing member 752.

A predetermined central area of the casing 1 has a protruding base 13 with a guiding groove 131 for said positioning rod 79 to pass through. Said positioning rod 79 has a rack 791 on its upper face. Also, a brace 78 is fixed to the protruding base 13. A positioning piece 76 is set inside the brace 78. A screw 761 is fixed to the positioning piece 76 for receiving a string so as to allow the lower end of the positioning piece 76 to be inserted or exited simultaneously from the rack 791.

Figure 7:
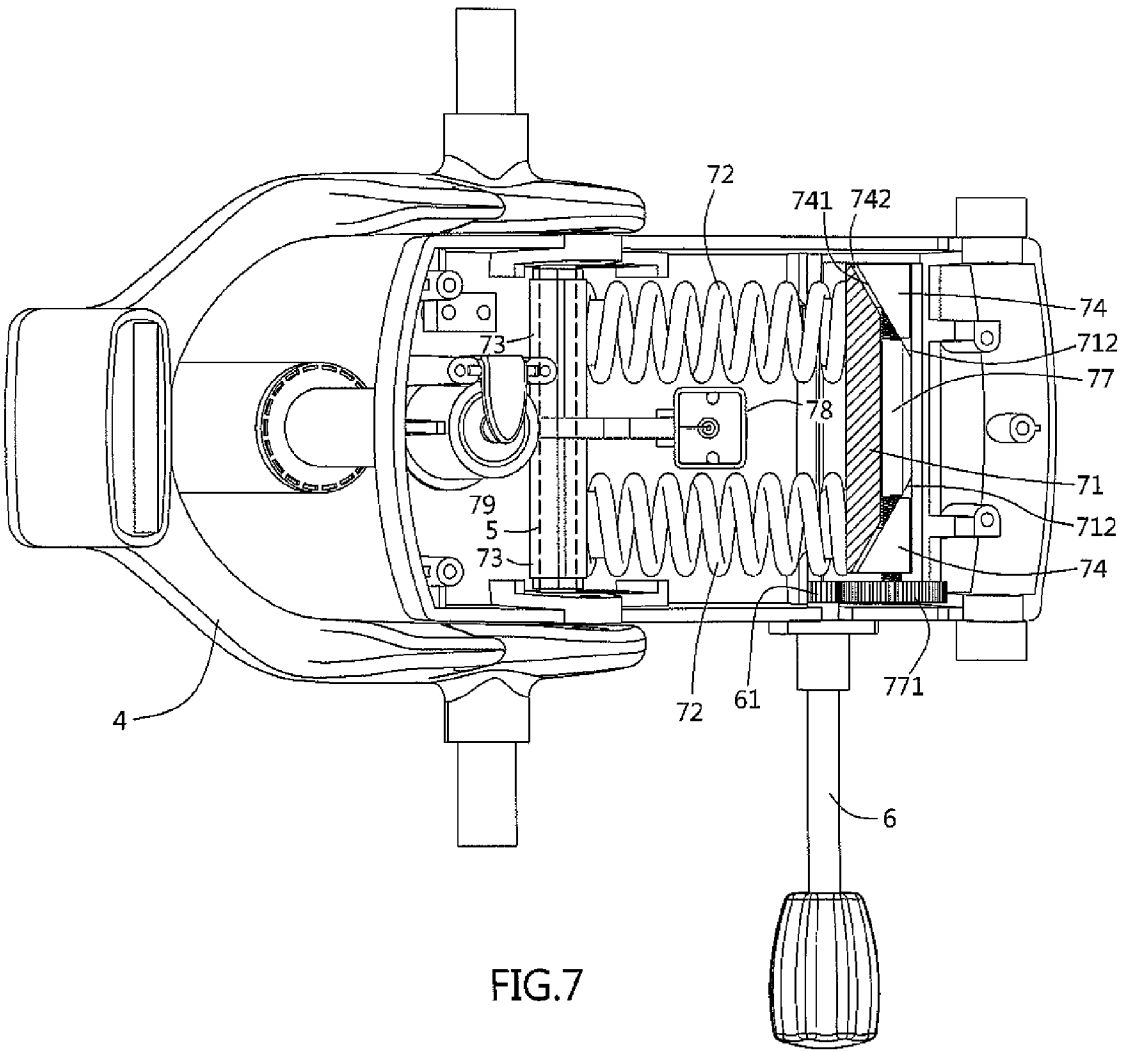
FIG. 7 is a perspective view of the elastic adjuster according to the present invention.
Figure 8:
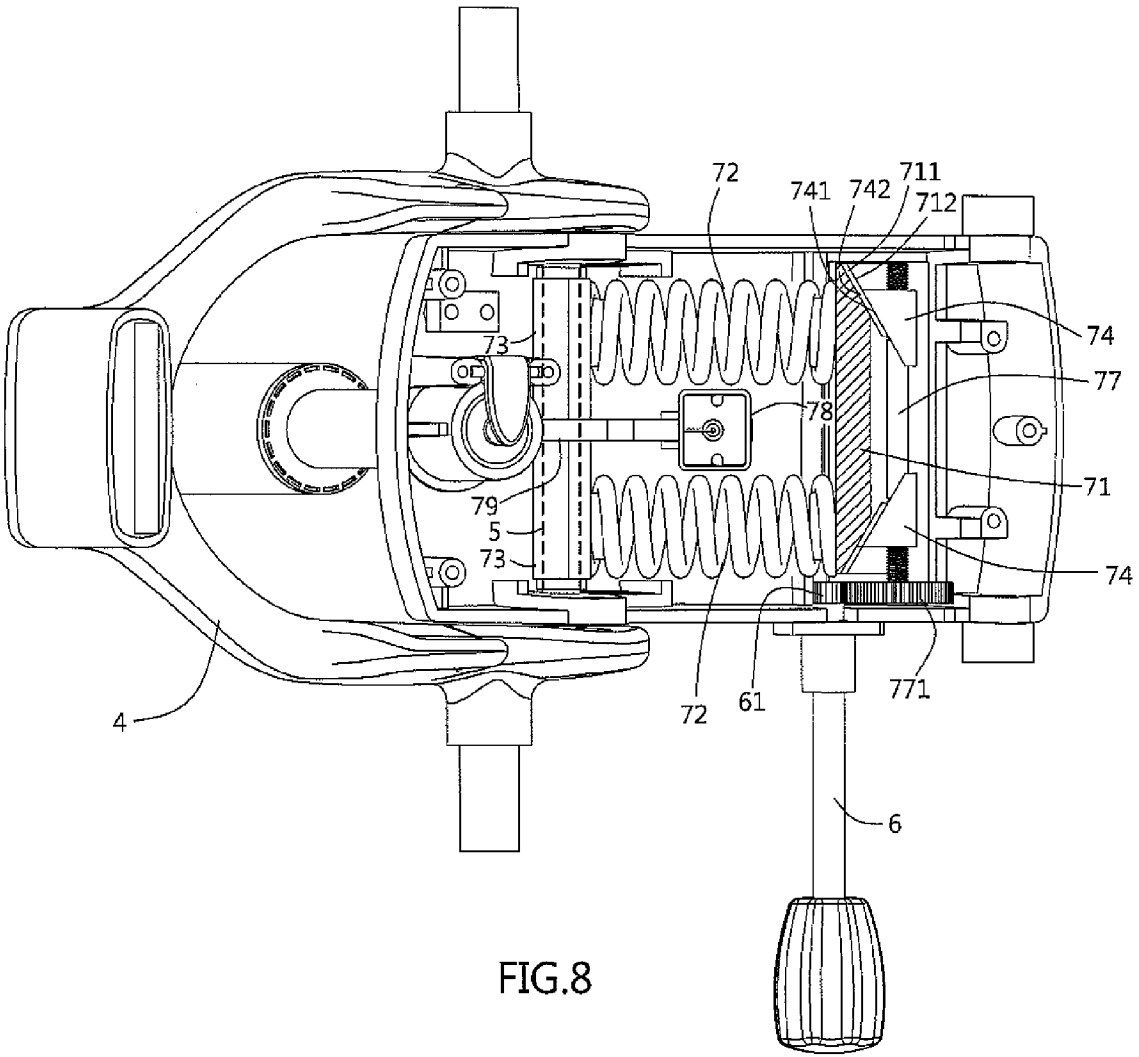
FIG. 8 is a perspective view of the adjustable movement of the elastic adjuster according to the present invention.

Therefore, when the positioning piece 76 is pulled up by the string and away from the rack 791 of the positioning rod 79, the positioning rod 79 can be moved freely within the guiding groove 131. Thus, the backrest supporter 4 can be tilted and swung forward and backward. Further, the two sides of the axle rod 5 are pressed by the elastic members 72 so as to allow the backrest supporter 4 to be swung elastically, that is to say, the backrest has a resilience effect while a user leans on it. The resilience of the backrest can be adjusted by the user rotating the turning bar 6. The turning bar 6 can drive the screw 77 to rotate so as to move the sliding pieces 74 relatively inward or outward (as shown in FIGS. 7 and 8). Furthermore, forcing the compressing base 71 to press the elastic members 72 or to exit, the elastic member 72 can force the axle rod 5 to allow the backrest supporter 4 to be adjusted in a proper resilience state of swing.

In addition, when the backrest supporter 4 is reclined in a predetermined angle, the pulling force to the positioning piece 76 can be released. Thus, the lower end of the positioning piece 76 can be inserted into the rack 791 of the positioning rod 79, so that the positioning rod 79 is not able to be moved within the guiding groove 131 freely and the backrest supporter 4 is locked in a fixed position. Therefore, the backrest of the chair can be therefore adjusted and positioned.

Figure 9:
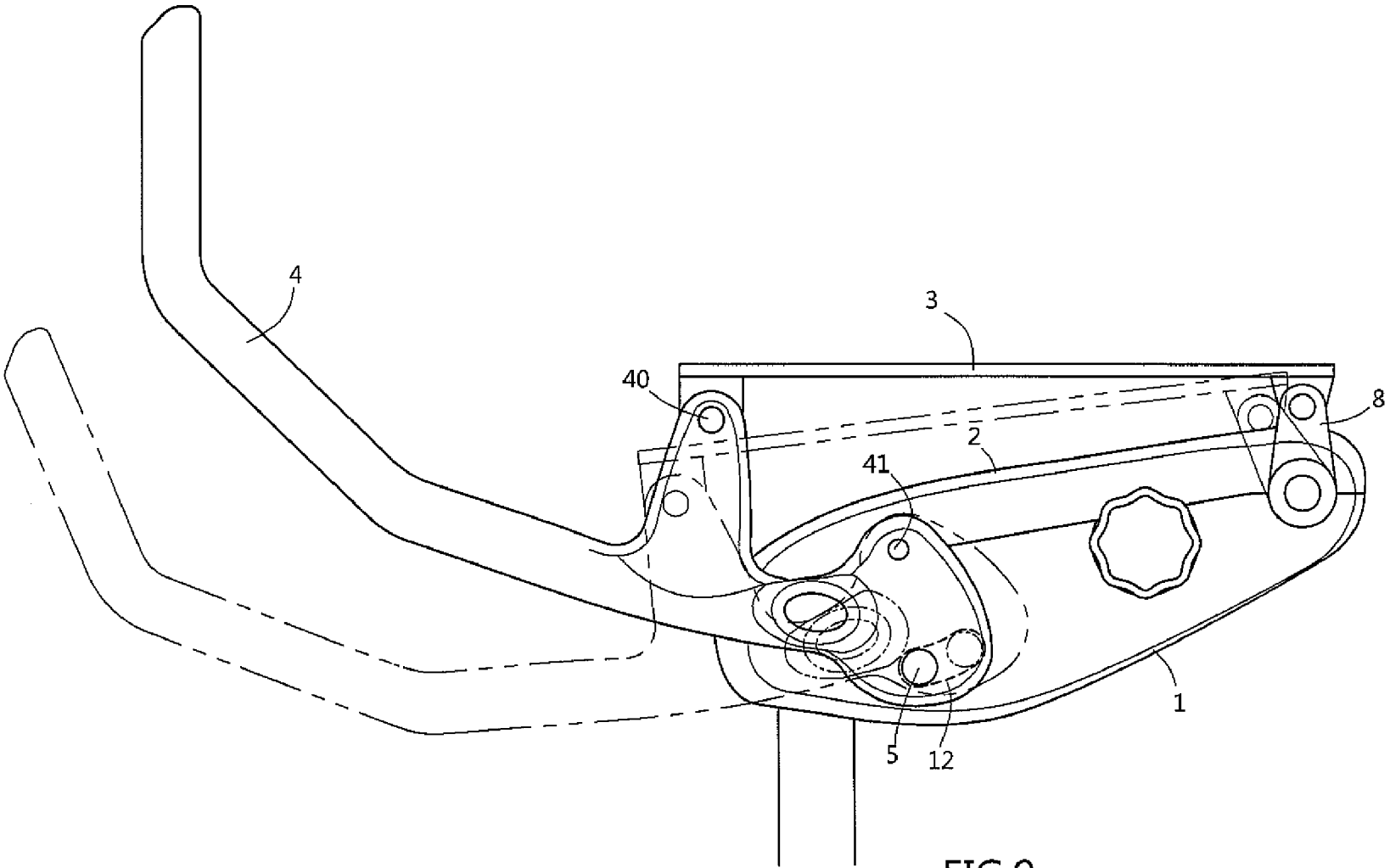
FIG. 9 is a perspective view of the tilting movement of the backrest supporter according to the present invention.

Furthermore, as shown in FIG. 9, when the backrest supporter 4 is changed with different angles of tilting and although the supporting base 3 is also inclined for tilting, the changes of the tilting angles will be small since the connecting member 8 is pivotally connected to the front end of the casing 1. Therefore, the user will not feel uncomfortable since the lifting range of the user's legs can be reduced while the user is leaning on the backrest.

What is claimed is:

1. A resilience tilt-adjusted device of a backrest for an office chair, with the device including a backrest supporter; a casing pivotally connected to the backrest supporter; an axle rod passed through the casing as well as the backrest supporter; and an elastic adjuster, wherein:

said elastic adjuster includes a compressing base and two elastic members disposed against one side of the compressing base, wherein ends of the two elastic members are leaned against said axle rod; wherein each end portion of another side of the compressing base has an inclined surface, wherein sliding pieces are arranged relatively to the inclined surfaces for operation, wherein the sliding pieces are respectively passed through with left and right threads of a screw, wherein the sliding pieces are moved axially inward or outward by turning the screw in different directions, wherein the compressing base can enter or exit from pressing the two elastic members.

2. The resilience tilt-adjusted device of a backrest as defined in claim 1, wherein two sides of the axle rod have resisting bases, wherein the ends of the two elastic members lean against the resisting bases.

3. The resilience tilt-adjusted device of a backrest as defined in claim 1, wherein the other side of the compressing base has an inclined guiding groove at each end portion, wherein corresponding inclined surfaces of the sliding pieces each have a guiding portion for inserting and sliding in the inclined guiding groove.

4. The resilience tilt-adjusted device of a backrest as defined in claim 1, wherein the screw has a gear portion, wherein the device further comprises a turning bar having a gear wheel portion arranged at the casing for clenching the gear portion of the screw.

5. The resilience tilt-adjusted device of a backrest as defined in claim 1, wherein a positioning rod with one free end having a rack is arranged and passed through the center of the axle rod, a guiding groove is disposed in the casing for passing through by the one free end of the positioning rod, a brace covers a positioning piece disposed fixedly at top of the guiding groove, and the positioning piece can be moved up and down so that the lower end of the positioning piece can insert or exit from the rack of the positioning rod.

6. The resilience tilt-adjusted device of a backrest as defined in claim 1, wherein a supporting base is pivotally connected between a lower part of the backrest and a front end of the casing for receiving a seat, and the supporting base is connected to the front end of the casing by a connecting member.

* * * * *